US008530058B1

(12) United States Patent
Chawla et al.

(10) Patent No.: US 8,530,058 B1
(45) Date of Patent: Sep. 10, 2013

(54) OXIDATION RESISTANT PB-FREE SOLDER ALLOYS

(75) Inventors: Nikhilesh Chawla, Tempe, AZ (US); Martha Dudek, Chandler, AZ (US)

(73) Assignee: Arizona Board of Regents, for and on behalf of Arizona State University, Scottsdale, AZ (US)

( * ) Notice: Subject to any disclaimer, the term of this patent is extended or adjusted under 35 U.S.C. 154(b) by 0 days.

(21) Appl. No.: 12/399,709

(22) Filed: Mar. 6, 2009

(51) Int. Cl.
*B32B 15/04* (2006.01)
*B32B 15/20* (2006.01)
*C22C 13/00* (2006.01)

(52) U.S. Cl.
USPC ..... 428/647; 420/560

(58) Field of Classification Search
USPC ..... 428/646, 647
See application file for complete search history.

(56) References Cited

U.S. PATENT DOCUMENTS

2007/0134125 A1* 6/2007 Liu et al. ..... 420/560
2009/0014746 A1* 1/2009 Ramirez et al. ..... 257/99

OTHER PUBLICATIONS

Chuang, "Rapid whisker growth on the suface of Sn-3Ag-0.5Cu-1.0Ce solder joints," Scripta Materialia, vol. 55, pp. 983-986, Sep. 2006.*
Dudek, et al., "Novel Rare Earth Containing Lead-Free Solders with Enhanced Ductility," JOM, pp. 57-62, Jun. 2006.*
Dudek, et al., "Microstructure and Mechanical Behavior of Novel Rare Earth Containing Pb-Free Solders," J. Electron. Materials, pp. 2088-2097, vol. 35 (12), (no month) 2006.*
Chuang, et al., "Abnormal growth of tin whiskers in a Sn-3Ag0.5Cu0.5Ce solder ball grid array package," J. Electron. Materials, pp. 1621-1627, vol. 35 (8), (no month) 2006.*

* cited by examiner

*Primary Examiner* — Michael La Villa
(74) *Attorney, Agent, or Firm* — Withrow & Terranova, P.L.L.C.

(57) ABSTRACT

A lead free solder consisting of a ternary eutectic composition of Sn-3.9Ag-0.7Cu with Ce in the amount of 0.5 to 2% by weight exhibits improved oxidation resistance increased ductility in comparison with other RE metals and is characterized by a homogeneous mixture of large grain $CeSn_3$ intermetallics in a Sn beta phase. In solder applications, the joints with the solder are resistance to interfacial fracture by distributing the strain within the solder interface increasing impact resistance.

3 Claims, 9 Drawing Sheets

Dark phases represent RE-containing intermetallics

Oxidized RE intermetallics appear dark and below the white line have not oxidized

OXIDATION RESISTANT PB-FREE SOLDER ALLOYS

FIELD OF THE INVENTION

The present invention relates to Pb free solders and, more particularly, to ternary eutectic compositions of Sn—Ag—Cu containing Ce for effecting improved oxidation resistance over other RE solders and improved ductility for use in electrical applications subject to impact damage.

BACKGROUND OF THE INVENTION

In recent years there has been a growing interest in Pb-free solder alloys doped with small amounts of rare earth (RE) elements due to enhanced physical and mechanical properties relative to conventional Pb-free alloys (Ref. 1-17). Several authors have shown that the addition of small amounts of RE elements can decrease alloy melting temperature (Ref. 2, 8, 14), improve wettability (Ref. 2, 5, 9, 16) and even promote strong bonding to semiconductors such as silicon (Ref. 1-13). Rare earths have also been shown to refine solder microstructure by decreasing Sn grain size (Ref. 2, 9, 10, 17), intermetallic particle size (Ref. 2, 9, 15, 17) and decrease the $Cu_6Sn_5$ layer that forms between the Cu substrate and the Pb-free solder (Ref. 14, 15). The mechanical response of these materials is dependent on the type of RE elements, concentration, and morphology. RE additions have been shown to increase the strength of Sn—$Ag^{0,0}$ and Sn—Ag—Cu alloys (Ref. 8, 9, 15, 16), increase strain-to-failure in Sn—$Ag^0$ and Sn—Ag—Cu alloys (Ref. 9), and improve creep resistance in Sn—$Ag^0$ and Sn—Ag Cu alloys (Ref. 7, 16).

In previous work (Ref. 11, 12), we have reported that small La additions (0.1 wt % and 0.5 wt %) to Sn—Ag—Cu resulted in an increase in ductility compared with Sn—Ag—Cu/Cu joints. At these small La concentrations, a homogenously distributed $LaSn_3$ intermetallic phase forms in the solder. We have shown that the $LaSn_3$ particles are directly responsible for the higher ductility observed in these materials, by allowing microscopic voids to nucleate throughout the solder volume (instead of localized strain at the solder-intermetallic interface), and homogenizing the strain in the solder joint.

Due to the reactive nature of RE elements with oxygen, some of these solder systems are prone to severe oxidation even under ambient conditions. In the case of La-containing solders, oxidation leads to degradation in the mechanical performance as well as poor reflow quality (Ref. 18). Chuang and co-authors (Ref. 19-22) have shown that a significant amount of Sn whiskering takes place on the surfaces of Pb-free solders containing Ce, La and Lu. Similar observations have been made by Jiang and Xian (Ref. 23) with solders containing Nd. It appears that the RE-rich intermetallic phases that form in these solders is highly reactive with oxygen leading to a complex oxidation process that produces Sn whiskers. The tendency of RE-containing phases to oxidize in other material systems has also been documented. Niu and co-authors (Ref. 24-26) have shown that RE-containing intermetallics in Fe, Co and Ag systems are susceptible to oxidation. Anzel observed the oxidation of Cu—Er and Cu—Yb phases in Cu alloys (Ref. 27). The La solders, while having increased ductility, the oxidation leads to shear fracturing at the interfaces of the solder joint providing unacceptable performance in electron applications requiring mechanical shock and drop resistance, desirable characteristics that are becoming increasingly important as consumer electronic products become smaller and more portable. The current industry standard lead free solders of Sn-4Ag-0.5Cu and Sn-3Ag-0.5Cu alloys are as much as 40% lower than Pb—Sn alloys in terms of shock performance.

SUMMARY OF THE INVENTION

The present invention provides a lead-free solder electrical solder based on a ternary eutectic composition of Sn—Ag—Cu, and variants thereof, containing Ce in amounts providing substantially improved ductility and oxidation resistance over other RE materials. Ce in minute amounts provides an order of magnitude increase in oxidation resistance over other RE materials in comparable amounts, and substantially increased ductility, 50% or greater, over Sn—Ag—Cu solders The base alloy may be utilized in the accepted ranges wherein Ag is in the amount of about 3.5 to 7.7 weight percent, Cu is in the amount of about 0.5 to 4.0 weight percent, with balance essentially Sn. The variants do not interfere with the formation of the soft intermetallics in the matrix providing the ductility and oxidation resistance. In one preferred form, the solder alloy comprises a Sn-3.9Ag-0.7Cu with Ce in an amount of 0.1-0.5 wt %. Microstructurally, these alloys contain Sn dendrites and a eutectic phase consisting of Sn, $Ag_3Sn$ and $Cu_6Sn_5$ particles, similarly found in conventional Sn—Ag—Cu alloys. In addition, a new Ce—Sn intermetallic phase, $CeSn_3$, is present, homogenously distributed in the microstructure and dendritic in morphology. The presence of Ce, in addition to improving the ductility of the solder, also refines the Sn dendrite microstructure, and decreases the thickness of the $Cu_6Sn_5$ intermetallic phase that forms upon reflow to a Cu substrate, which has been determined to be prone to interfacial fracture under shear loading. With the present solder, the stresses are more uniformly distributed in the solder matrix, reducing the interfacial loading and providing a solder joint shock resistance comparable to Pb—Sn alloys The alloy is formed in a process promoting the grain growth and homogenization of the $CeSn_3$ intermetallic phase. Therein, the alloy components are heated in an oxygen deficient atmosphere, vacuum or inert gas, to a holding temperature of above the solidus temperature of liquid Sn and its Ce—Sn intermetallics, isothermally held for an extended period during which the molten mixture is repeatedly stirred or agitated to promote homogenization of the liquid melt, followed by rapid quenching. The process results in a matrix wherein the $CeSn_3$ intermetallic is uniformly distributed and resides below the outer surfaces In one aspect, the invention provides a lead free solder comprising: a ternary eutectic composition of Sn, Ag, and Cu with an alloy component of Ce in the amount of about 0.5 to 2.0 weight percent in a matrix characterized by homogeneously distributed fine grain $CeSn_3$ intermetallic particles dendritic in morphology, Sn dendrites and a eutectic phase consisting of Sn, $Ag_3Sn$ and $Cu_6Sn_5$ particles. The lead free solder may include Ag in the amount of about 3.5 to 7.7 weight percent, and Cu is in the amount of about 0.5 to 4.0 weight percent. The lead free solder preferably includes Ag of about 3.9 weight percent, Cu of about 0.7 weight percent, and Ce of about 0.1 to 0.5 weight percent, with the balance essentially Sn.

In another aspect, the invention provides lead free solder consisting essentially of about 3.9 weight percent Ag, 0.7 weight percent Cu, Ce of about 0.5 to 2.0 weight percent, and the balance Sn.

In another aspect, the invention provides a method of making a lead free solder characterized by improved ductility and oxidation resistance comprising the steps of: melting a ternary eutectic mixture of Sn, Ag, and Cu or variants thereof with about 0.5 to 2.0 weight percent Ce under vacuum conditions and a partial pressure of $O_2$ less than 20 ppm at an elevated temperature of above the liquidus temperature of Sn and intermetallics thereof for an extended period with periodic mixing; quenching said mixture to ambient temperature under conditions producing homogeneously distributed fine grain CeSn3 intermetallic particles dendritic in morphology, Sn dendrites and a eutectic phase consisting of Sn, $Ag_3Sn$ and $Cu_6Sn_5$ particles; and forming the quenched mixture to a format suitable for use in effecting a solder joint between articles. The elevated temperature may be about 1000° C. The extended period may be about 2 to 4 hours.

In another aspect, the invention provides a solder joint comprising; a pair of spaced copper substrates mechanically joined by a solder matrix consisting of a ternary eutectic mixture of Sn, Ag and Cu or variants thereof with about 0.1 to 2.0 weight percent Ce. The Ag may be in the amount of about 3.5 to 7.7 weight percent, and Cu may be in the amount of about 0.5 to 4.0 weight percent. Further, Ag may be about 3.9 weight percent, Cu may be about 0.7 weight percent, and Ce may be about 0.1 to 0.5 weight percent, with the balance is essentially Sn.

In another aspect, the invention provides a method for reducing whiskering in a solder joint between Cu substrates wherein the solder has a Sn rich-RE matrix, comprising: adding as an alloying component to the solder Ce in the amount of about 0.1 to 0.5 weight percent of the matrix wherein the matrix is processed under conditions providing homogenously distributed fine grain $CeSn_3$ intermetallic particles dendritic in morphology, Sn dendrites and a eutectic phase consisting of Sn, $Ag_3Sn$ and $Cu_6Sn_5$ particles.

BRIEF DESCRIPTION OF THE DRAWINGS

The above and other features and advantages of the invention will become apparent upon reading the description taken in conjunction with the accompanying drawings in which.

DETAILED DESCRIPTION OF EMBODIMENTS

The oxidation resistant Pb free electrical conductor solder of the present invention consist of ternary compositions, and variants thereof, of Sn, Ag, Cu with Ce as an alloying component and suitable for soldering operations in the range of less than about 250° C. The base alloy may be utilized in the accepted ranges wherein Ag is in the amount of about 3.5 to 7.7 weight percent, Cu is in the amount of about 0.5 to 4.0 weight percent, with balance essentially Sn. A particularly good alloy used for establishing the characteristics and performance herein has about 3.9 weight percent Ag, 0.7 weight percent Cu, 0.1 to 0.5 wt % Ce, with the balance being essentially Sn. The alloys possess excellent oxidation resistance, in contrast with other rare earth metal solders that are highly susceptible to oxidation. The alloys also possess increased ductility over the base Sn—Ag—Cu alloys. These combined attributes provide a lead free solder providing a matrix shear strength having mechanical shock and drop resistance approaching lead based solders. The alloys are characterized by homogeneously distributed fine grain $CeSn_3$ intermetallic particles dendritic in morphology, Sn dendrites and a eutectic phase consisting of Sn, $Ag_3Sn$ and $Cu_6Sn_5$ particles.

Figure 1:
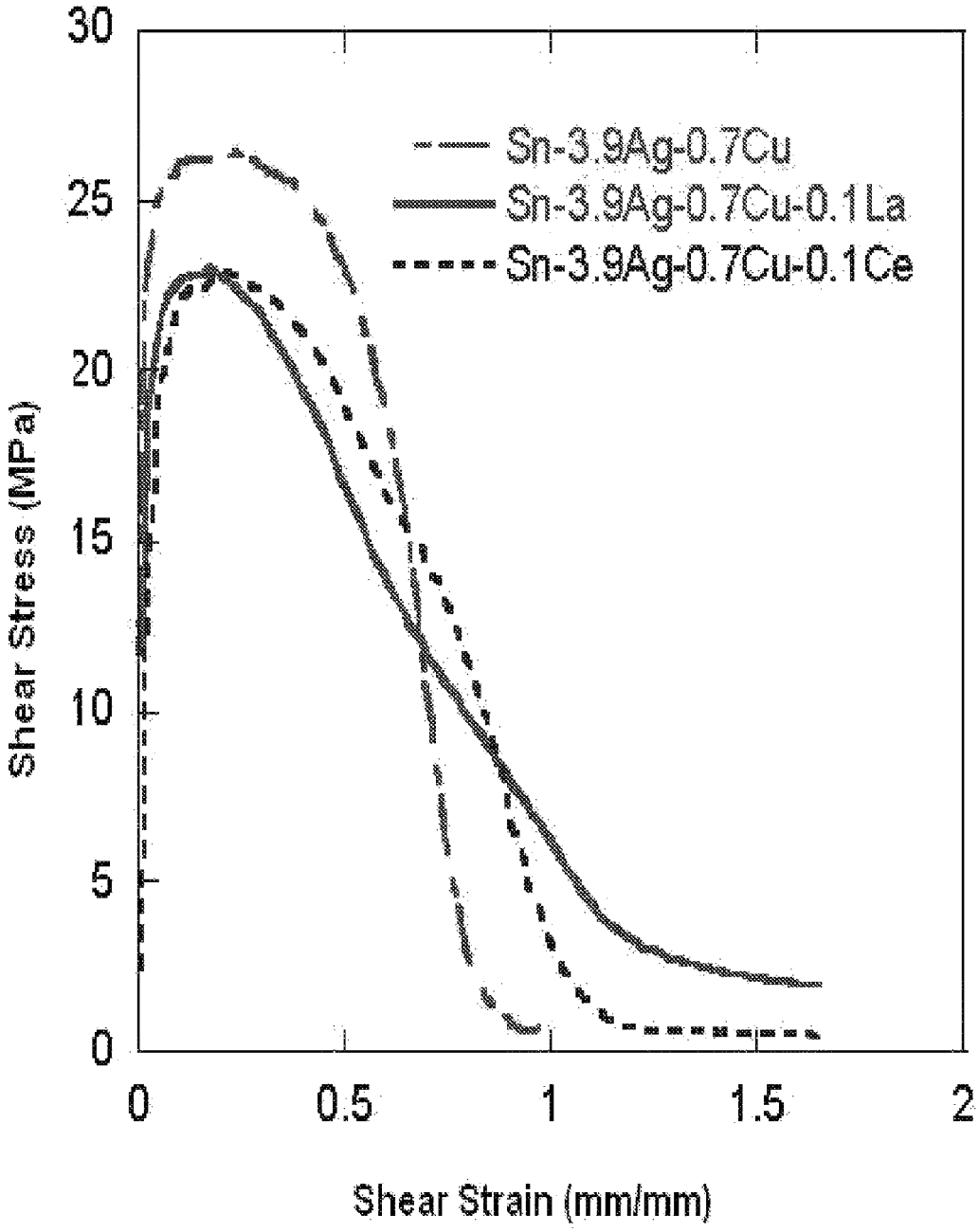
FIG. 1 is a shear stress v. shear strain diagram for alloys (a) Sn-3.9Ag-0.7Cu, (b) Sn-3.9Ag-0.7Cu-0.1 La, (c) Sn-3.9Ag-0.7Cu-0.1 Ce.
Figure 2:
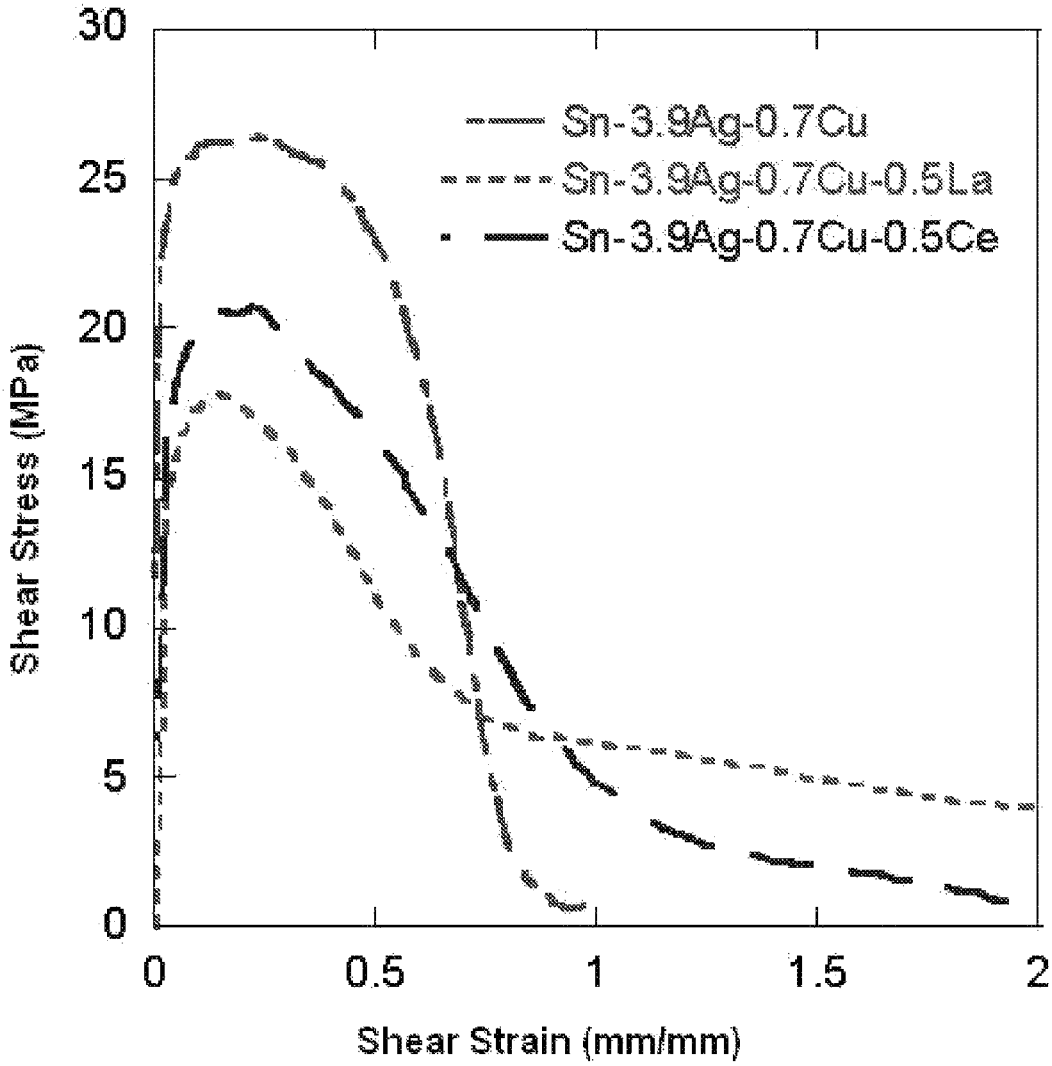
FIG. 2 is a shear stress v. shear strain diagram for alloys (a) Sn-3.9Ag-0.7Cu, (b) Sn-3.9Ag-0.7Cu-0.5La, (c) Sn-3.9Ag-0.7Cu-0.5Ce.

Referring to FIG. 1, there is shown a shear stress v. shear strain curves for the base alloy and 0.1 Ce and 0.1 La alloys. The La alloy exhibited a previously known increased ductility over the base alloy. The Ce alloy, while less than the La alloy, exhibited a 70% increase over the base alloy. Referring to FIG. 2, the RE amounts were increased to 0.5 weight percent, and again the 0.5La alloy had the highest ductility, while Ce alloy exhibited a 100% increase over the base alloy.

Figure 3:
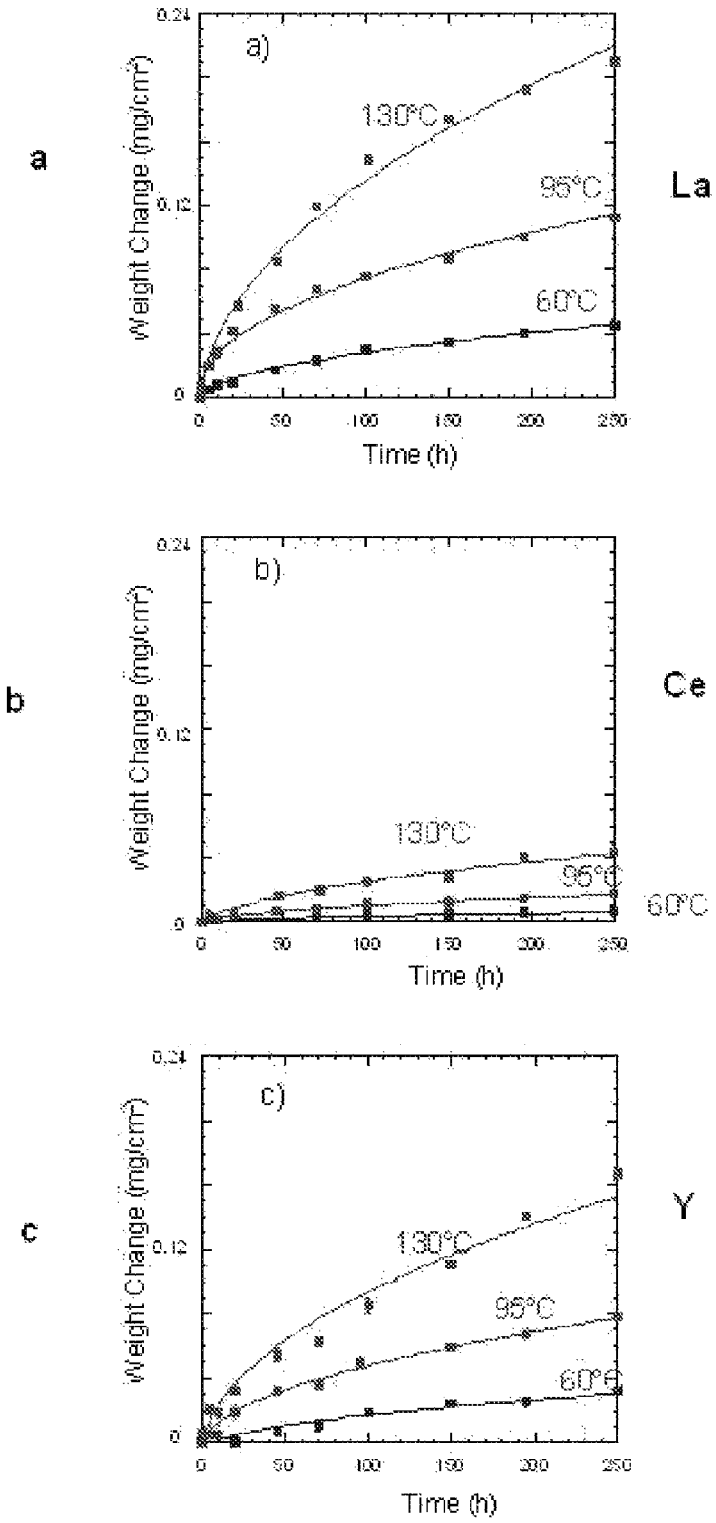
FIG. 3 are normalized mass increase vs. time curves for (a) Sn-3.9-0.7Ag-2La, (b) Sn-3.9Ag-0.7Cu-2Ce, and (c) Sn-3.9Ag-0.7Cu-2Y at 60° C., 95° C. and 130° C.

The present alloys also exhibits superior oxidation resistance over other RE metals in the base alloy as shown in FIG. 3. Therein, base alloys with 2 La, 2Ce and 2Y (a, b and c respectively) were tested for weight change in accordance with the protocol described below. The higher weight percent was used to provide data compatible with the capabilities of the test instrumentation. At all test temperatures, the 2 Ce exhibited substantially greater oxidation resistance than the other RE materials over the indicated times and temperatures.

Figure 4:
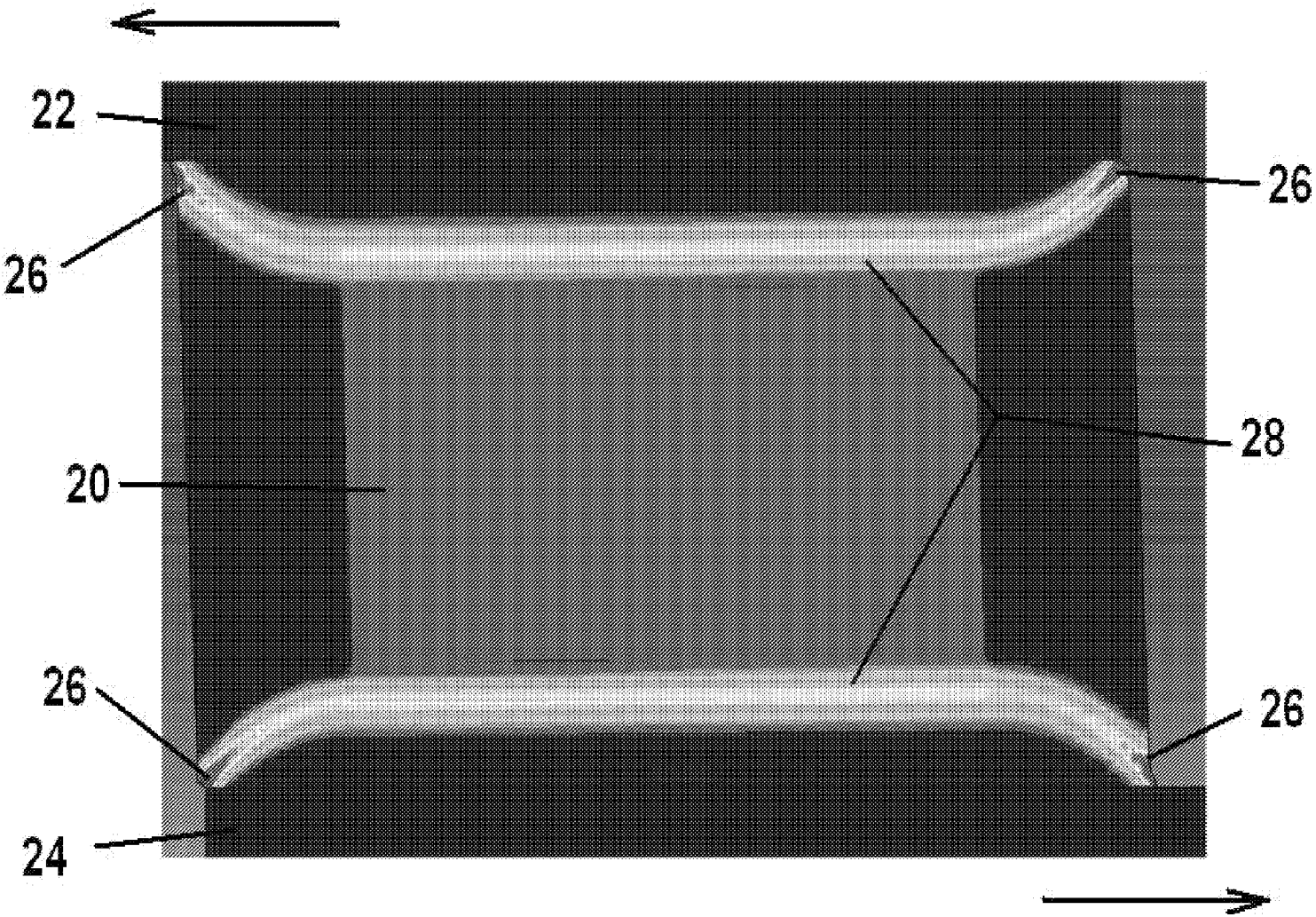
FIG. 4 is a finite element simulation of shear deformation for a lead free Sn rich electrical conductor solder.
Figure 5:
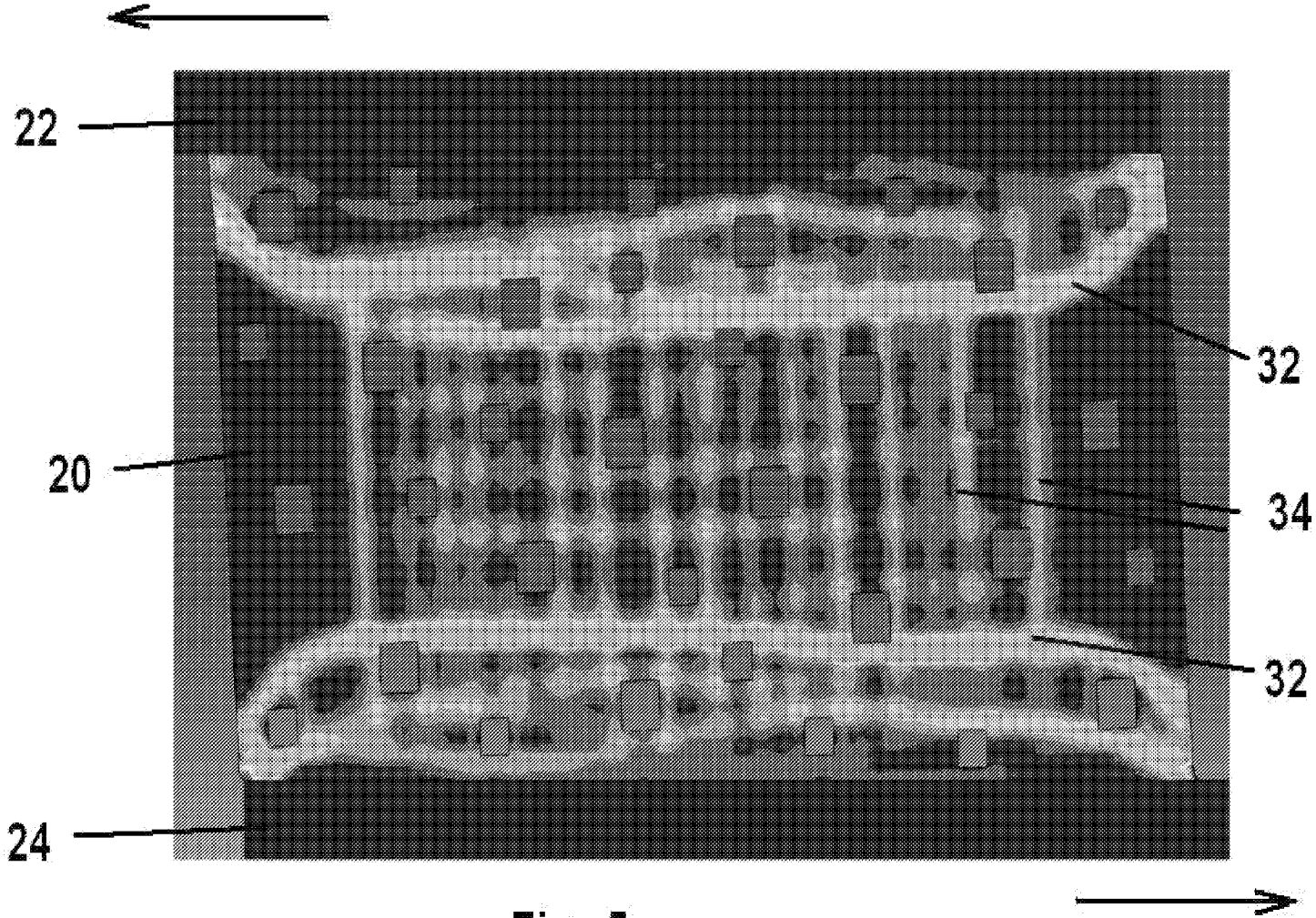
FIG. 5 is a finite element simulation of shear deformation for a lead free Sn rich electrical conductor solder with Ce—Sn intermetallic particles.

This dual improvement in ductility and oxidation resistance translates into greater shear resistance at a typical solder joint as shown in FIGS. 4 and 5 based on a computer simulation. In the base alloy of FIG. 4, the RE free, tin rich matrix solder joint 20 between copper substrates 22, 24 when loaded in shear as noted by the arrows had a localized high force loadings 26 at the leading outer interfaces edges with the substrate and elevated force levels 28 unilaterally adjacent the interfaces. Such distribution is characteristic of conditions causing delamination under impact loading. In, FIG. 5, with the Ce addition to the matrix, the lateral force levels 30 are reduced and distributed with transverse force level 32, without localized intensity at the leading outer interfaces, indicative of distributed ductile loading and improved shock resistance.

Preparation of the solder alloy comprises the controlled melting of high purity ingots of the alloy components under oxygen deficient conditions at a controlled rate to an isothermal holding melt temperature for an extended period of time during which the melted alloy mixture is gently agitated to promote homogenization of the Ce intermetallics followed by rapid quenching to ambient conditions.

Figure 6:
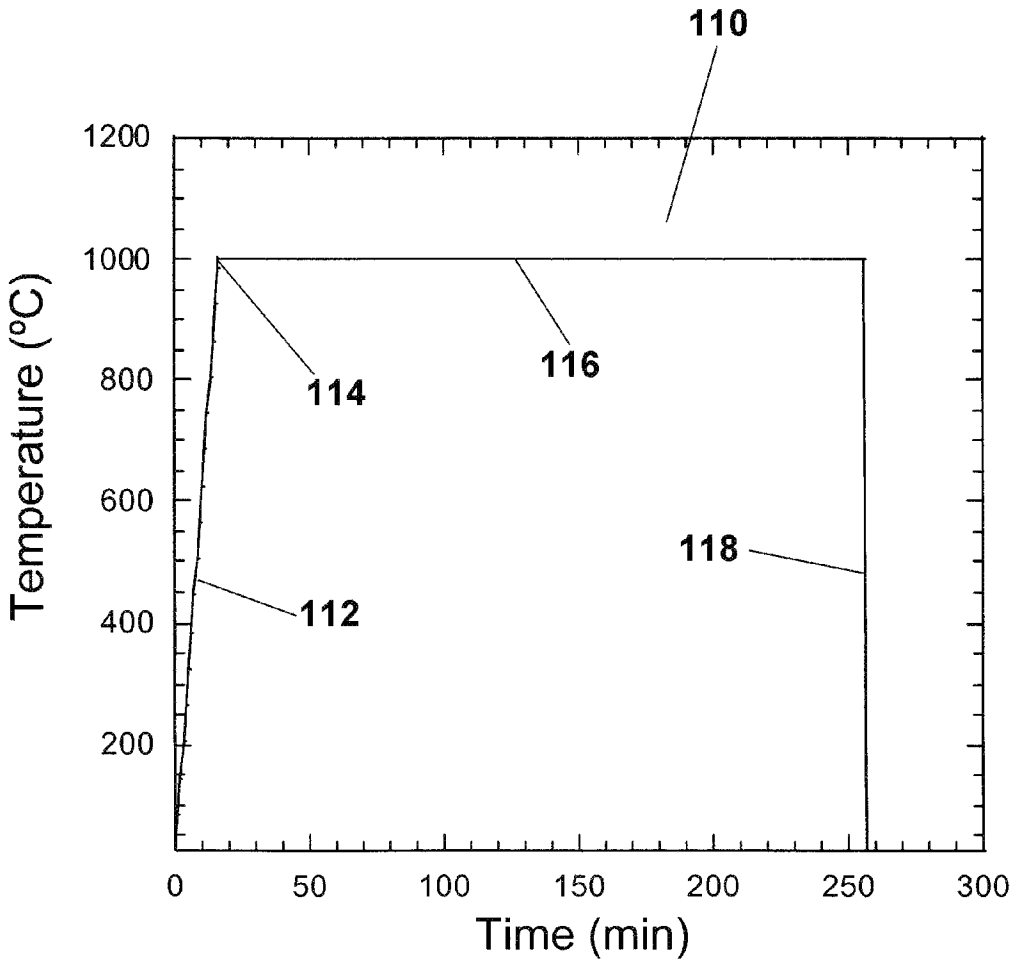
FIG. 6 is graph of the time-temperature profile for the preparation of the solder alloys of the invention.

More specifically and referring to FIG. 6, the process 110 for the solder alloy consists of heating the alloy components, in high purity ingot form, in suitable vessel in an oxygen deficient atmosphere, vacuum or inert gas, at a heating rate 112 of about 1° C./sec to an isothermal holding temperature 114 forming a molten mixture and held for a holding period 116 of about 4 hours. During the holding period 116, the molten mixture is gently periodically agitated or stirred to promote homogenization of the liquid melt. Thereafter, the molten mixture is rapidly quenched by appropriate cooling, i.e. water quenching, to ambient conditions.

The heating rate 112 is determined by the heating equipment and is typically in the range of up to about 1° C. per second. The holding temperature 14 is above the liquidus of Sn and the intermetallics. A suitable temperature has been found to be about 1000° C. that has been found to maintain the various intermetallic constituents in solution while developing desired grain size and distribution of the consistent $CeSn_3$ intermetallic volume and grain size. Holding periods within the range of about 2 to 4 have been found to yield satisfactory results. Below this period, insufficient volume and grain size may attained. Above this period, grains size may be excessive. During the holding period, the molten material is stirred or agitated, continuously or periodically, to promote uniform homogenization of the $CeSn_3$ intermetallic particles.

Example 1

Vacuum-melted ingots of Sn—Ag—Cu with 2 wt % La, Ce or Y were prepared. High purity Sn-3.9Ag-0.7Cu solder alloy ingots (Indium, Ithaca, N.Y.) were cut into small rectangular pieces (6.5×6.5×13 mm) and mixed with La, Ce or Y shot, roughly 2-8 $mm^3$ in size (ESPI, Ashland, Oreg., 99.995% pure, packed under argon?). Due to their reactive nature with oxygen, the RE elements and solder were mixed in a helium glove box with a partial pressure of $O_2$ less than 20 ppm to provide an oxygen deficient environment limiting further oxidation. Inside the glovebox, the RE elements and solder alloy were mixed in a quartz ampoule (12 mm in diameter). With a closed stopcock, the quartz ampoule was taken out of the glove box, evacuated to $10^{-5}$ Torr and hermetically sealed with a blow torch. The sealed ampoules were heated to 1000° C. for 4 hours, and periodically mixed by rotating the ampoule, in order to homogenize the liquid metal. The ampoules were then water quenched, removed from the ampoule, and sectioned.

Microstructure characterization was conducted on the processed ingot material. Ingots were sectioned and polished to a final finish of 0.05 μm colloidal silica. Optical microscopy, scanning electron microscopy (SEM) and quantitative image analysis (ImageJ, Gaithersburg, Md.) were conducted to quantify the size and spacing of RE-containing intermetallic phases. The intermetallic phases of interest were fit to ellipses to estimate their size and aspect ratio. Interparticle spacing was calculated using a finite-body tessellation method. Energy dispersive spectroscopy (EDS) analysis and X-ray Diffraction (XRD) were also used to confirm the composition of the RE-containing intermetallics. XRD characterization was conducted (Panalytical XPert Pro MRD) with a real time multiple strip (RTMS) Xcelerator detector, using CuK radiation. The specimens were scanned from a 2θ of 20° to 90° with a step increment and total time of 0.025°/s and 45 min, respectively.

The oxidation behavior of Sn-3.9Ag-0.7Cu-2La, Sn-3.9Ag-0.7Cu-2Ce, and Sn-3.9Ag-0.7Cu-2Y was studied at 60° C., 95° C., and 130° C. Oxidation of the materials was characterized by measuring the weight change at various time intervals at constant temperatures. Ingots of each material were sectioned into small disks approximately 0.5 mm thick. The disks were polished to a 2000 grit finish, ultrasonically cleaned, fixed in a pre-oxidized aluminum mount and weighed. The weight was measured on an analytical balance with a resolution of ±0.2 mg. After the initial weight measurement, samples were placed into a pre-heated furnace. At certain time intervals, the samples were taken out of the furnace, allowed to cool and then weighed. Weighing at each interval was repeated three times to ensure accuracy of the measurement. The samples were then placed back in the hot furnace for a given time period and the process was repeated for up to 250 h. These samples were also prepared for microstructure characterization. The disks were polished to a 0.05 μm colloidal finish and placed into the furnace, followed by SEM analysis. Samples oxidized for 100 h were also cross-sectioned and polished to analyze the depth of oxide penetration. XRD was conducted on the surfaces of sample disks oxidized at 95° C. for 250 h to determine the composition and phase of the oxidation products.

A Focused Ion Beam (FIB) was used to cross-section oxidized samples of Sn-3.9Ag-0.7Cu-2La to study Sn whiskers formed during oxidation. Samples were first coated with a 1 μm thick Pt layer using the ion beam to protect from subsequent beam damage. A trench was milled using the ion beam at 30 kV and a current of 5 nA. The initial cleaning cross-section was performed at 30 kV and 0.3nA, with subsequent cleaning sections using smaller currents to a final ion beam current of 30 pA. Samples were imaged with both secondary electron (5 kV, 98 pA) and ion beam (30 kV, 10 pA) modes.

Figure 8:
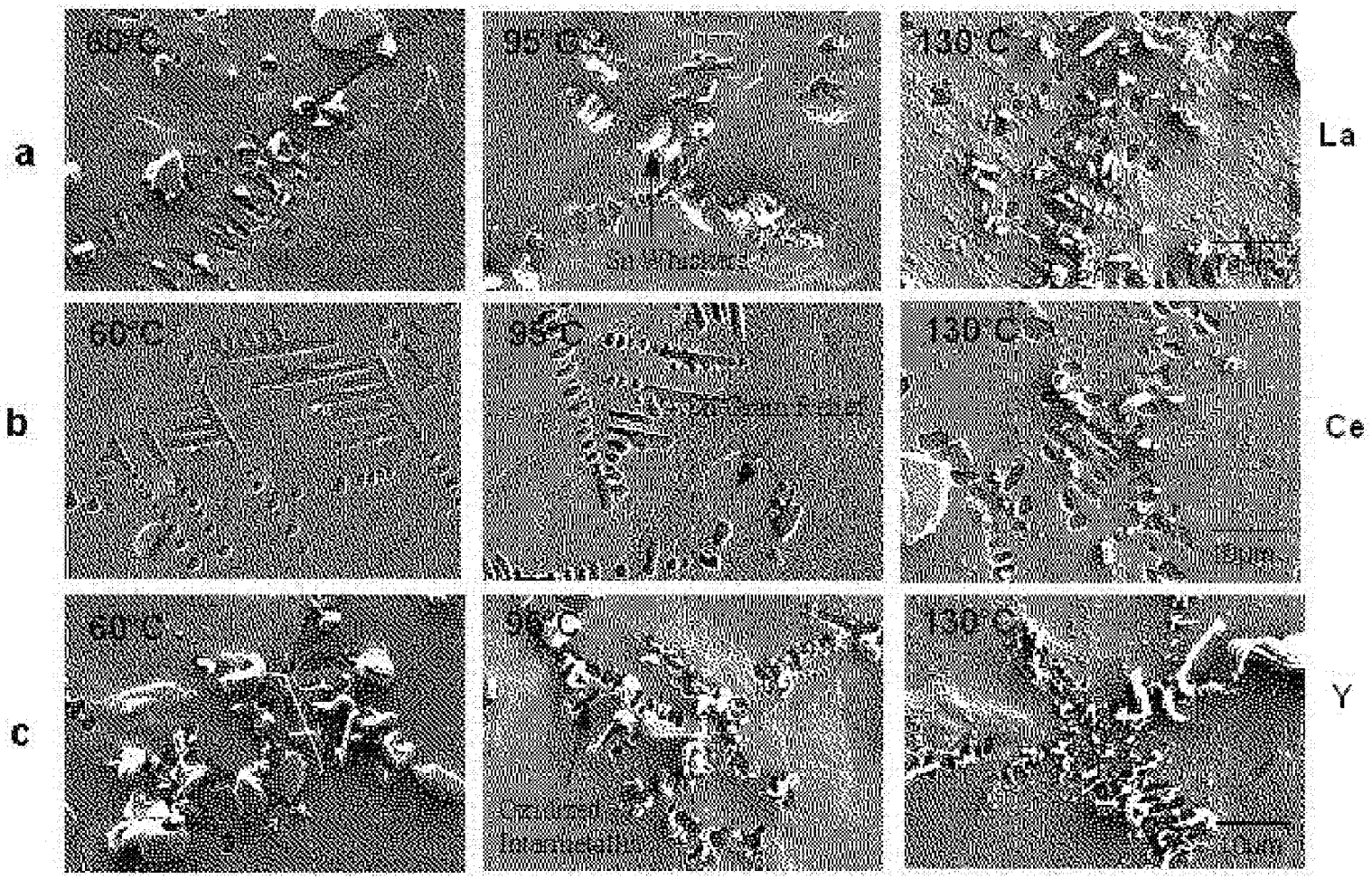
FIG. 8 are high magnification SEM images of (a) LaSn3 in Sn-3.9Ag-0.7Cu-2La, (b) CeSn3 in Sn-3.9Ag-0.7Cu-2Ce, and (c) Ysn3in 3.9Ag-0.7Cu-2Y with some RE intermetallics outlined.
Figure 9:
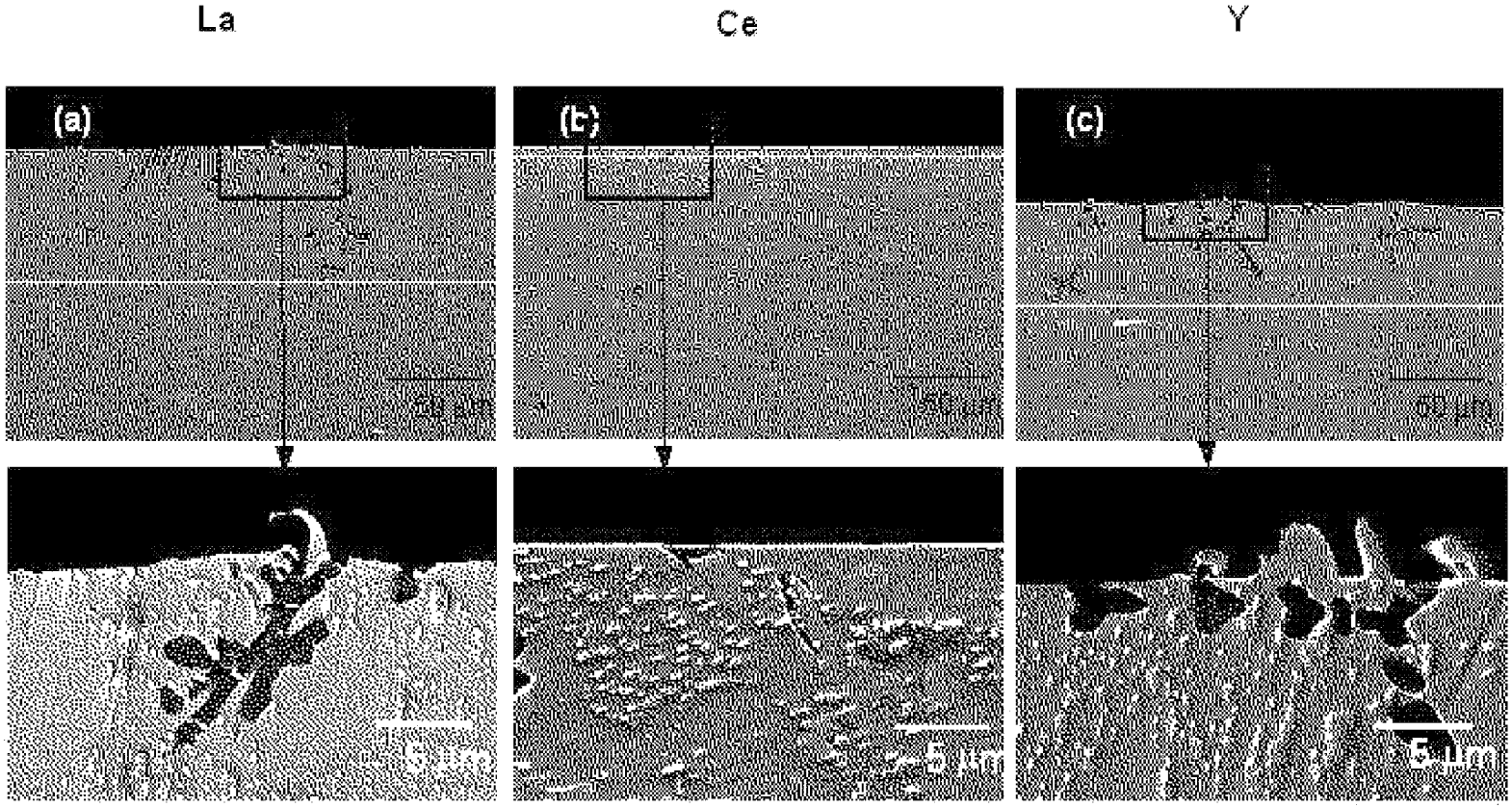
FIG. 9 are XRD scans for as-processed (unoxidized) (a) Sn-3.9-0.7Ag-2La, (b) Sn-3.9Ag-0.7Cu-2Ce, and (c) Sn-3.9Ag-0.7Cu-2Y and (d) Sn-3.9Ag-0.7Cu.

Representative microstructures of as-processed Sn-3.9Ag-0.7Cu-2La, Sn-3.9Ag-0.7Cu-2Ce, and Sn-3.9Ag-0.7Cu-2Y are shown in FIG. 8. All microstructures consisted of Sn-dendrites and a eutectic mixture of $Ag_3Sn$ and $Cu_6Sn_5$ intermetallics distributed in the Sn-rich matrix. As shown in FIG. 9, the resulting RE-containing phases (dark phases in the micrographs) consist of homogeneously distributed $LaSn_3$, $CeSn_3$ and $YSn_3$ particles, respectively. The RE phases are considerably larger in size than the other intermetallic phases, i.e., $Ag_3Sn$ and $Cu_6Sn_5$, and surround the boundaries of the Sn dendrites. The $LaSn_3$ intermetallics are actually complex dendrites, with small amounts of entrapped Sn within each dendrite.

Figure 7:
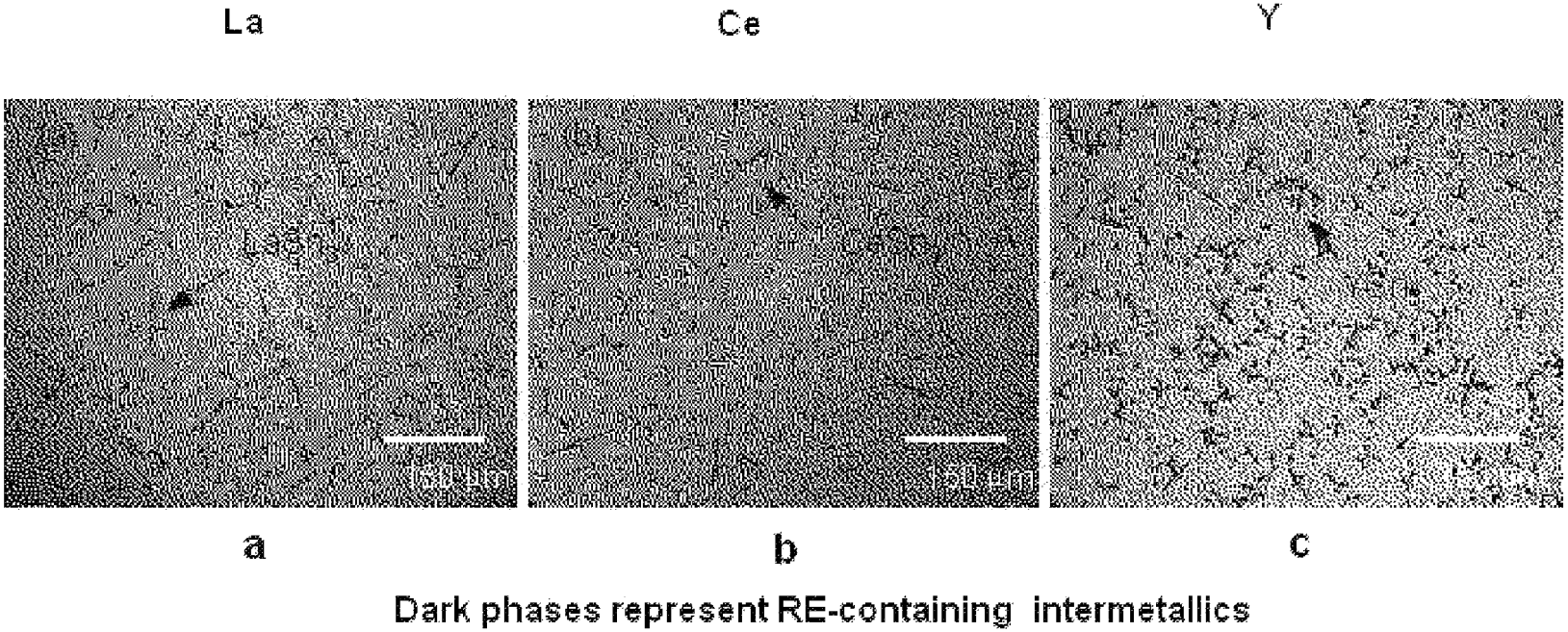
FIG. 7 are optical images of (a) Sn-3.9-0.7Ag-2La, (b) Sn-3.9Ag-0.7Cu-2Ce, and (c) Sn-3.9Ag-0.7Cu-2Y wherein dark phases represent RE-containing intermetallics.

As shown in FIG. 7, the size, distribution and morphology of $LaSn_3$, $CeSn_3$ and $YSn_3$ are fairly similar. Briefly, micrographs were segmented into black and white images. Image analysis software (ImageJ, Gaithersburg, Md.) was employed to approximate the particles to ellipses. The ratio of the major-to-minor axis of the ellipse was used to calculate the aspect ratio of the particle. The quantitative analysis is shown in Table 1, below, which include volume fraction, size, spacing and aspect ratio for the RE intermetallics present in Sn-3.9Ag-0.7Cu-2La, Sn-3.9Ag-0.7Cu-2Ce and Sn-3.9Ag-0.7Cu-2Y. The volume fraction of the intermetallics is around 8-9%. The particles have an aspect ratio of about 2 and range in size from 3-6 μm.

TABLE 1

Summary of microstructure characterization for as-processed solder alloys

| Intermetallic | Sn—3.9Ag—0.7Cu | | |
|---|---|---|---|
| Characteristics | 2La | 2Ce | 2Y |
| Volume fraction (%) | 9.1 ± 0.2 | 8.6 ± 0.4 | 8.9 ± 0.3 |
| Major Axis (μm) | 5.6 ± 1.0 | 6.1 ± 1.2 | 5.4 ± 0.8 |
| Minor Axis (μm) | 2.3 ± 0.6 | 3.2 ± 0.8 | 2.8 ± 0.7 |
| Aspect Ratio | 2.3 ± 0.5 | 1.9 ± 0.3 | 2.0 ± 0.6 |
| Interparticle Spacing (μm) | 9.6 ± 1.0 | 10.1 ± 0.7 | 11.2 ± 0.9 |

FIG. 3 shows weight change versus time for Sn-3.9Ag-0.7Cu-2La, Sn-3.9Ag-0.7Cu-2Ce, and Sn-3.9Ag-0.7Cu-2Y at 60° C., 95° C. and 130° C. The data was normalized by the surface area of the samples. The rate of oxidation increases with temperature for all the materials studied. The La and Y-containing solders behave similarly, with similar oxidation curves at each temperature. Sn-3.9Ag-0.7Cu-2Ce, however, has significantly better oxidation resistance. The oxidation process for all alloys in the temperature range studied obeys a parabolic rate law, as shown by the linear relationship in the normalized weight change vs. time$^{1/2}$ plots. This suggests a diffusion controlled process. Parabolic oxidation may be described by the equation:

$$\frac{d\xi}{dt} = \frac{k'}{\xi} \quad [1]$$

where ξ is the thickness of the oxide scale, k' is the rate constant and t is the oxidation time. This equation can be modified for parabolic weight increase according to:

$$\left(\frac{\Delta W}{A}\right)^2 = k_p t \quad [2]$$

where ΔW is the mass change of the sample, A is the sample surface area, $k_p$ is the parabolic rate constant and t is the time in the oxidizing environment. The values of $k_p$ computed from the kinetic data in are given in Table 2. Notice that the oxidation rate for Sn-3.9Ag-0.7Cu-2Ce is an order of magnitude smaller than for Sn-3.9Ag-0.7Cu-2La and Sn-3.9Ag-0.7Cu-2Y in the temperature range studied. The activation energy for oxidation was calculated from the Arrhenius equation relating temperature dependence on oxidation rate constants:

$$k_p = Ae^{\frac{-Q}{RT}} \quad [3]$$

where Q is the activation energy for oxidation and T is absolute temperature. The activation energies are given in Table 3, below in the temperature range of 60° C. to 130° C. For the temperature range studied, the activation energies for the alloys are very similar. This signifies that the oxidation mechanism for the materials is likely the same. A more detailed discussion of the precise mechanisms for oxidation are presented in the next section.

TABLE 2

Oxidation Rates

| Material | Oxidation Rate × $10^{-4}$, $K_p$ (mg/cm$^2$ · h$^{1/2}$) 60° C. | 95° C. | 130° C. |
|---|---|---|---|
| Sn—3.9Ag—0.7Cu—2La | 29.6 ± 0.6 | 82.0 ± 2.7 | 141 ± 9.3 |
| Sn—3.9Ag—0.7Cu—2Ce | 4.5 ± 0.1 | 11.8 ± 1.7 | 29.7 ± 1.8 |
| Sn—3.9Ag—0.7Cu—2Y | 22.8 ± 1.9 | 93.0 ± 2.9 | 103 ± 5.5 |

TABLE 3

Activation Energies

| Material | Activation Energy (kJ/mol) |
|---|---|
| Sn—3.9Ag—0.7Cu—2La | 25.1 |
| Sn—3.9Ag—0.7Cu—2Ce | 30.0 |
| Sn—3.9Ag—0.7Cu—2Y | 24.0 |

Based on SEM and EDS data, oxidation of Sn-3.9Ag-0.7-2La, Sn-3.9Ag-0.7-2Ce, and Sn-3.9Ag-0.7-2Y alloys is almost entirely controlled by the oxidation of the $LaSn_3$, $CeSn_3$ and $YSn_3$ intermetallics, respectively. The oxide covers the intermetallic surfaces as a dark layer. Surfaces of the oxidized samples after 100 h at 60° C., 95° C. and 130° C. are shown in FIG. 5. Several interesting features can be seen on the surface of the oxidized specimens. First, Sn grain relief is visible in the Sn dendrite regions surrounding the oxidized RE intermetallics. This feature seems more prominent at lower temperatures, and is present in all three alloys. Secondly, Sn whiskering takes place on the surfaces of the alloys during oxidation. Hillock-type whiskers are present on the specimen surfaces of Sn-3.9Ag-0.7Cu-2La and Sn-3.9Ag-0.7Cu-2Y at all temperatures. A smaller amount of whiskering takes place on Sn-3.9Ag-0.7Cu-2Ce at 130° C., but virtually no whiskering is present at 60° C. and 95° C. Some needle-like whiskers also are seen on Sn-3.9Ag-0.7Cu-2La and Sn-3.9Ag-0.7Cu-2Y. It is clear from the micrographs that Sn-3.9Ag-0.7Cu-2Ce has a far less propensity for whisker formation compared with Sn-3.9Ag-0.7Cu-2La and Sn-3.9Ag-0.7Cu-2Y. This observation suggests that there is a positive correlation between Sn whisker growth and RE oxidation.

As the oxidation temperature is increased, Sn-3.9Ag-0.7Cu-2La and Sn-3.9Ag-0.7Cu-2Y undergo more severe whisker growth. At low temperatures, the hillock-type whiskers seem to grow close to the Sn matrix/RE intermetallic interface. As the oxidation temperature is increased, hillock-type whisker growth adjacent to the RE intermetallics is accompanied by the growth of whiskers in the eutectic region of the alloys surrounding the RE particles. This is most apparent at 130° C. Cracking is also present on the surfaces of the oxide phases for Sn-3.9Ag-0.7Cu-2La and Sn-3.9Ag-0.7Cu-2Y.

Backscattered electron SEM images of polished cross-sections of Sn-3.9Ag-0.7Cu-2La, Sn-3.9Ag-0.7Cu-2Ce, and Sn-3.9Ag-0.7Cu-2Y oxidized for 100 h at 95° C. are shown in FIG. 7. The dotted line in the figure denotes the depth of oxide penetration, i.e. RE intermetallic particles below the line have not oxidized. It appears that oxide infiltration is dominated by the diffusion of oxygen into the RE-containing phases, and not through the Sn matrix. The dark oxides also appear to be somewhat porous, and some cracking is observed in these regions in areas under the sample surface. The oxide reaction front in both the La and Y-containing solders has advanced a substantial amount into the bulk of the solder, while for the Ce-containing solder, the oxide does not penetrate past the surface. Only RE intermetallics in direct contact with the specimen surface oxidized, indicating little oxygen diffusion through the Sn matrix was taking place. Penetration depths after 100 h of oxidation were measured and are shown in 4. As with the oxidation rates, Sn-3.9Ag-0.7Cu-2Ce had an order magnitude smaller oxide penetration compared with Sn-3.9Ag-0.7Cu-2La and Sn-3.9Ag-0.7Cu-2Y.

TABLE 4

Oxide penetration depths after 100 h of oxidation

| Material | Oxidation Penetration @ 100 h (μm) 60° C. | 95° C. | 130° C. |
|---|---|---|---|
| Sn—3.9Ag—0.7Cu—2La | 26 ± 5 | 47 ± 16 | 97 ± 19 |
| Sn—3.9Ag—0.7Cu—2Ce | 2 ± 1 | 5 ± 3 | 27 ± 9 |
| Sn—3.9Ag—0.7Cu—2Y | 23 ± 8 | 46 ± 12 | 75 ± 34 |

Concentrations of Sn, RE, O, Ag and Cu were measured on cross-sections of the oxidized specimens by means of EDS. The concentration of Sn in the oxide layer is very low. It increases at the alloy/$LaSn_3$ interface to the concentration level expected by the nominal stoichiometry of this phase. The oxide layer is rich in both La and O. At a short distance from the oxide-intermetallic interface no Sn enrichment was observed. Since the EDS data showed that Sn was present in small amounts within the oxide layer only, and that there was no Sn enrichment in the intermetallic phase, the Sn appears to have migrated to the adjacent Sn matrix. It is apparent that the RE element in the $RESn_3$ intermetallics are oxidizing, resulting in a RE-rich oxide. Selective oxidation wherein a less noble constituent in an alloy is preferentially oxidized is a common phenomenon, particularly when the oxides of each alloy constituent do not react with one another and are mutually insoluble. According to the theory for selective oxidation by Wagner, the less noble metal is selectively oxidized forming an outer oxide layer, and the more noble metal avoids oxidation and diffuses from the oxide front into the bulk of the alloy, causing an enrichment of that element in the alloy. Gibbs free energies of formation for the RE-O phases of interest and Sn—O phases are shown in Table 5. The free energies of formation indicate that the RE constituents are in fact the less noble elements in $RESn_3$ intermetallics.

TABLE 5

Gibbs free energies of formation at for RE and Sn oxides

| Oxide Compound | Gibbs Free Energy of Formation (kJ/mol) |
|---|---|
| SnO | −251.9 |
| $SnO_2$ | −515.8 |
| $La_2O_3$ | −1705.8 |
| $CeO_2$ | −1024.7 |
| $Y_2O_3$ | −1816.7 |

The selective oxidation of RE in $RESn_3$ may take place by the following net reactions:

$$2LaSn_3+\tfrac{1}{2}O_2\rightarrow La_2O_3+6Sn \quad [4]$$

$$CeSn_3+O_2\rightarrow CeO_2+3Sn \quad [5]$$

$$2YSn_3+\tfrac{1}{2}O_2\rightarrow Y_2O_3+6Sn \quad [6]$$

Jiang and Xian[0] proposed that the $RESn_3$ may first decompose to elemental RE and Sn before oxidation. This seems unlikely as the $RESn_3$ phases are thermodynamically stable at low temperatures. Without externally applied forces or constraints, the oxidation of $LaSn_3$ and $CeSn_3$ according to the above equations would result in volume increases of about 16.2% and 12.3%, respectively. However, the intermetallic phases are constrained from expansion during oxidation due to the surrounding Sn matrix. Due to the inevitable reaction of the RE with O, the Sn in the oxidized zone is under a state of compression. The stresses imposed on the Sn result in its outward migration to the surrounding Sn matrix, instead of migration into the intermetallic. Once in the Sn matrix, we believe that the Sn atoms migrate along dislocations and/or grain boundaries in the direction of the compressive stress gradient, to the stress-free surface of the specimen, causing whisker growth. It is well recognized that compressive stresses are a necessary condition for Sn whisker formation on thin Sn platings. It is believed that Sn atoms diffuse from regions of high compressive stresses (generally caused by the growth of a $Cu_6Sn_5$ intermetallic layer) to the stress-free film surface by diffusion along columnar Sn grain boundaries. Observations seen in the current study agree well with those reported in the literature.

As noted previously, at higher temperatures hillock-type whiskers are accompanied by the growth of smaller whiskers in the eutectic region of the solder. One possible explanation for this is the increasing contribution of lattice diffusion of Sn at higher temperatures. At lower temperatures, Sn diffusion along grain boundaries in close proximity to the oxidized particle is likely energetically favorable, resulting in hillock-type whiskers close to the intermetallic/Sn matrix interface. As the temperature is increased, lattice diffusion plays a stronger role and the Sn atoms are able to travel much farther to the surrounding eutectic region. In fact, it has been observed that lattice diffusion in Sn alloys under stress becomes significant at temperatures >100° C., which correlates well with our observations XRD was conducted on the oxidized specimens in order to determine the oxide phases that were formed. According to the respective RE-O phase diagrams, $La_2O_3$, $CeO_2$, and $Y_2O_3$ are expected to exist at ambient temperatures and pressure. The XRD patterns for all three alloys showed no oxide peaks. The RE-Sn intermetallic phases were no longer detectable. $SnO_2$ and SnO also were not detected. Chuang and co-authors[0] observed that $CeSn_3$ oxidizes to form crystalline $CeO_2$. It is possible, however, that at low temperatures and under certain oxidizing conditions the oxide phases that form on intermetallics can be "weakly crystalline" or possibly amorphous. The phases that form during oxidation of these materials requires further study.

As mentioned previously, parabolic oxidation dependence indicates that diffusion of the reacting species is rate-controlling. Diffusion of oxygen through the oxide layer, or the diffusion of the RE element in the RE intermetallic to the oxide/metal interface could be rate-determining processes. Generally, when the diffusion of the metal ion to the oxide/alloy is rate-controlling, a depleted region of the reacting metal will develop in the alloy at the alloy/oxide interface. As this layer grows, diffusion of the metal ion becomes more sluggish, and the oxidation rate decreases due to a decreased availability of metal ions for reaction, however, no enrichment layer was present in these alloys. Therefore, diffusion through the oxide layer is likely the rate-controlling process in these alloys.

Initial oxidation takes place rather quickly and a dark layer of oxide can be seen optically within several minutes. As with other metal systems, growth of the oxide layer begins with the adsorption of oxygen onto the intermetallic surface (monolayer). The nucleation of oxide islands a few atomic layers thick follow. Once these oxide nuclei coalesce to form a continuous layer, further oxidation proceeds by a diffusion mechanism. Since the oxide was observed to grow inward from the specimen surface, oxygen must diffuse through the oxide layer to the intermetallic-oxide interface. When oxygen reaches the interface, a fresh oxide is formed.

Oxygen can diffuse through the oxide in several ways including ionic diffusion and molecular diffusion through defects in the oxide. Molecular oxygen can penetrate through the cracks and pores in the oxide layer to—or close to—the oxide/intermetallic interface. It could then react with the RE ions to form an oxide phase. This type of transport takes place in non-protective oxide layers and would not obey parabolic kinetics. If the oxide layer was initially protective, and cracking occurred during further oxidation, paralinear oxidation kinetics would be expected. Here, the rate is initially parabolic, but a transition to linear behavior is observed once significant cracking or porosity is present. Although porosity and cracking was observed in the oxide phases, parabolic kinetics dominated. Thus, the diffusion of oxygen is likely governed by the diffusion of oxygen ions through the oxide layer via a vacancy mechanism. The vacancy mechanism process consists of the exchange of oxygen ions and oxygen vacancies. Both electrons and vacancies travel from the intermetallic-oxide interface to the outer surface of the oxide layer. A reaction takes place between two electrons, a vacancy and an oxygen molecule. This produces an oxygen ion at the oxide surface, which is then able to move through the oxide via a vacancy process. It is known that both $La_2O_3$ and $Y_2O_3$ can be oxygen-deficient, described more accurately as $La_2O_{3-x}$ and $Y_2O_{3-x}$. Deficiency in oxygen results in a high concentration of oxygen vacancies, making oxygen diffusion through the structures easier. Thus, oxygen diffusion rates through the oxides can be high. Any differences in oxide structure (and related non-stoichiometry) may result in different oxygen diffusion rates through the various oxides, and lead to the differences in observed oxidation rates between alloys.

In application, the solder may be provided in various formats including solder wire, sheet, ingots and powder using conventional solder manufacturing practices. For electronics application demanding improved oxidation resistance and ductility, the solder is applied as a paste using solder reflow procedure. A preferred application thermal profile for a solder joint reflow process 200 is shown in FIG. 32. Therein, a surface mount component is attached to a circuit board and the assembly passed to a preheat zone 202 wherein the assembly is heated at lower level heating rate of about 0.25° C./s to a holding temperature of about 120° C. The assembly then enters a thermal hold or soak zone 204 at the holding temperature wherein the flux is volatilized and an equilibrium temperature is attained. In the reflow zone 206 the assembly is heated at a rate of about 0.250 C to the liquidus melting temperature of about 220° C. The assembly is held thereat a temperature not exceeding a maximum temperature of about 240° C. for a reflow period of about 40 s and thereafter enters a cooling zone 208 for air cooling and solidification of the joint.

The relationship between composition, microstructure and oxidation behavior of Pb-free solders containing rare earth elements were investigated. Based on the experimental results above, the following conclusions can be drawn:

(a) The as-processed microstructure of Sn-3.9Ag-0.7Cu-2La, Sn-3.9Ag-0.7Cu-2Ce and Sn-3.9Ag-0.7Cu-2Y contains RE intermetallics of the type $RESn_3$ that are dendritic in nature, and exist in the eutectic region of the solder microstructure and along the Sn dendrite boundaries. The RE intermetallic phases between the alloys had similar volume fraction, morphology, size and spacing.

(b) Sn-3.9Ag-0.7Cu-2Ce exhibited the best oxidation resistance, with an order of magnitude smaller oxidation rate for all temperatures studied.

(c) Selective oxidation of the $RESn_3$ phases occur, leading to a RE-rich oxide. Oxygen diffuses through the oxide film to the metal/oxide interface most likely by an oxygen vacancy mechanism.

(d) Oxidation of the RE intermetallics leads to compressive stresses that ultimately causes the formation of Sn whiskers on the surface of the material.

(e) A joint based on Sn-3.9Ag-0.7Cu-0.1 to 0.5Ce exhibits a distributed shear stress resulting from ductility and oxidation resistance properties reduces interfacial loading leading to joint fracturing experienced in other RE metals in the base solder.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and description herein are intended to be illustrative and are not in any sense limiting of the invention, which is defined solely in accordance with the following claims.

REFERENCES

1. A. Ramirez, H. Mavoori, S. Jin. *Appl. Phys. Lett.* 80, 3, (2002) pp. 398-400.
2. C. M. L. Wu, D. Q. Yu, C. M. T. Law, and L. J. Wang. *Mater. Res.* 17, 12, (2002) pp. 3146-3154.
3. Z. Xia, Z. Chen, Y. Shi, N. Mu and N. Sun. *J. Electron. Mater.* 31, 6 (2002) pp. 564-567.
4. Z. G. Chen, Y. W. Shi, Z. D. Xia, and Y. F. Yan. *J. Electron. Mater.* 31, 10, (2002) pp. 1122-1128.
5. L. Wang, D. Q. Wu, J. Zhao and M. L. Huang. *Mater. Lett.* 56, (2002) pp. 1039-1042
6. C. M. L. Wu, C. M. T Law, D. Q. Yu, and L. Wang. *J. Electron. Mater.* 32, 2, (2003) pp. 63-69.
7. Z. G. Chen, Y. W. Shi, Z. D. Xia, and Y. F. Yan. *J. Electron. Mater.* 32, 4, (2003) pp. 235-243.
8. M. Dittes and H. Walter. *Soldering & Surface Mount Tech.* 15, 1, (2003) pp. 50-54.
9. D. Q. Yu, J. Zhao, and L. Wang. *J. Alloy. Compd.* 376, (2004) pp. 170-175
10. C. M. T. Law, C. M. L. Wu, D. Q. Yu, M. Li and D. Z. Chi. *IEEE transactions on advanced packaging.* 28, 2 (2005) pp. 252-258.
11. M. A. Dudek, R. S. Sidhu, N. Chawla and M. Renavikar. *J. Electron. Mater.* 35, 12, (2006) pp. 2088-2097.
12. M. A. Dudek, R. S. Sidhu and N. Chawla. *JOM.* 58, 6, (2006) pp. 57-62.
13. D. Q. Yu, C. M. L. Wu and Y. W. Wong. *J Mater Sci: Mater Electron.* 18, (2007) pp. 1057-1063.
14. C. M. L. Wu and Y. W. Wong. *J Mater Sci: Mater Electron.* 18, (2007) pp. 77-91
15. H. Hao, J. Tian, Y. W. Shi, Y. P. Lei and Z. D. Xia. *J. Electron. Mater.* 36, 7, (2007) pp. 766-774.
16. Y. Shi, J. Tian, H. Hao, Z. Xia, Y. Lei and F. Guo. *J. Alloy. Compd.* 453, (2008) pp. 180-184.
17. M. Pei and J. Qu. *J. Electron. Mater.* 37, 3, (2008) pp. 331-338.
18. M. A. Dudek and N. Chawla. *J. Electron Mater.* (2008) in preparation.
19. T. H. Chuang. *Scripta Mater.* 55, (2006) pp. 983-986.
20. T. H. Chuang and S. F. Yen. *J. Electron. Mater.* 35, 8, (2006) pp. 1621-1627.
21. T. H. Chuang, H. J. Lin and C. C. Chi. *Scripta Mater.* 56, (2007) pp. 45-48.
22. T. N. Chuang, C. C. Chi and H. J. Lin. *Metall. Mater. Trans. A.* 39A, (2008) pp. 604-612.
23. B. Jiang and A. P. Xian. *Phil. Mag. Let.* 87, 9, (2007) pp. 657-662
24. Y. Niu, G. Y. Fu, W. T. Wu and F. Gesmundo. *High Temp. Mater. Processes.* 18, 3, (1999) pp. 159-172.
25. Y. Niu, F. Gesmundo, M. Al-Omary and J. Song. *J. Alloy. Compd.* 317-318, (2001) pp. 573-577.
26. Y. Niu, Y. S. Li, F. Gesmundo and F. Viani. *Intermetallics.* 8, (2000) pp. 293-298.
27. I. Anzel. *Z. Metallkd.* 94, 9, (2003) pp. 993-1000.

What is claimed:

1. A lead free solder alloy consisting essentially of about 3.9 weight percent Ag, 0.7 weight percent Cu, Ce of about 0.1 to 2.0 weight percent, and the balance Sn, wherein Sn, Ag, and Cu form a ternary eutectic composition in a matrix, and characterized by:

homogeneously distributed fine grain $CeSn_3$ intermetallic particles dendritic in morphology, wherein the $CeSn_3$ intermetallic particles are substantially uniformly distributed and below an outer surface, Sn dendrites, and a eutectic phase consisting of Sn, $Ag_3Sn$ and $Cu_6Sn_5$ particles, and wherein the alloy exhibits an oxidation rate of $4.5\times10^{-4}$, $K_p$ ($mg/cm^2\ h^{1/2}$), or less at 60'C and an at least 70% increased ductility relative to a Sn—Ag—Cu alloy consisting of about 3.9 by weight percent of Ag, 0.7 by weight of Cu, and a balance of Sn.

2. The lead free solder of claim 1 wherein oxidation of the alloy remains substantially free of hillock-type whiskers at 60° C.

3. The lead free solder of claim 1 wherein the solder exhibits a weight change less than 0.04 $mg/cm^2$ at 130° C. for approximately 250 hours.

* * * * *